United States Patent [19]

Noda et al.

[11] Patent Number: 4,502,968

[45] Date of Patent: Mar. 5, 1985

[54] LUBRICATING AGENTS FOR PROCESSING FIBERS AND METHOD OF PROCESSING THERMOPLASTIC SYNTHETIC FIBER FILAMENTS THEREWITH

[75] Inventors: Ippei Noda; Osamu Ogiso, both of Aichi, Japan

[73] Assignee: Takemoto Yushi Kabushiki Kaisha, Aichi, Japan

[21] Appl. No.: 564,168

[22] Filed: Dec. 22, 1983

[30] Foreign Application Priority Data

Mar. 30, 1983 [JP] Japan ..... 58-55475

[51] Int. Cl.[3] ..... D06M 13/18; D06M 13/40; D06M 13/38

[52] U.S. Cl. ..... 252/8.8; 252/8.9; 556/413; 556/419; 556/427; 556/429; 556/438; 556/440

[58] Field of Search ..... 252/8.8, 8.9; 556/413, 556/419, 427, 429, 438, 440

[56] References Cited

U.S. PATENT DOCUMENTS

| | | | |
|---|---|---|---|
| 3,234,252 | 2/1966 | Pater | 556/440 |
| 3,792,071 | 2/1974 | Nitzsche et al. | 556/440 |
| 3,981,898 | 9/1976 | Lohse et al. | 556/439 |
| 4,331,797 | 5/1982 | Martin | 556/438 |

*Primary Examiner*—Maria Parrish Tungol

*Attorney, Agent, or Firm*—Keiichi Nishimura

[57] ABSTRACT

A lubricating agent for processing thermoplastic synthetic fibers contains at least one new type of silyl polyether obtainable by a reaction between polyether of a special type derivable by ring-opening addition polymerization of cyclic ether monomers and halogenated substituted silane. If such lubricating agent is used appropriately during the processing of thermoplastic synthetic fibers, both the coefficient of fiber friction and the rate of generating tar can be reduced.

4 Claims, No Drawings

LUBRICATING AGENTS FOR PROCESSING FIBERS AND METHOD OF PROCESSING THERMOPLASTIC SYNTHETIC FIBER FILAMENTS THEREWITH

BACKGROUND OF THE INVENTION

This invention relates generally to lubricating agents for processing fibers and a method of processing fiber filaments by said lubricating agents and more particularly to a novel type of lubricating agents for processing fibers which can both produce excellent lubricity and reduce the rate of tar generation and a method of processing thermoplastic synthetic fiber filaments by using such lubricating agents.

Fabrics are made of many kinds of thermoplastic synthetic fibers such as polyester, polyamide, polypropylene and polyacrylnitrile or cellulose-type fibers such as rayon, cupra and acetates as well as natural fibers. Many processes are involved in the fabrication such as weaving, drawing, false twisting, twisting and pasting although some of these processes may be combined into a single process. Various kinds of lubricating agents are used in these processes.

It has been well known that these lubricating agents must be able to produce excellent lubricity and to reduce the rate of tar generating. For this reason, use has been made of not only mineral oils and aliphatic esters but also many kinds of lubricating agents having as main constituents, for example, polyoxyalkylene ethers (for example, U.S. Pat. No. 3,338,830), esters of polyoxyalkylene ether and aliphatic acid, formals of polyoxyalkylene alkyl ether, esters of polyoxyalkylene bisphenol and aliphatic acid, orthosilicate ester and silicone alkylene oxide copolymer. Although they all have certain advantages, however, each of these lubricating agents for processing fibers is unsatisfactory in view of the aforementioned requirements. Mineral oils and aliphatic esters, for example, do not inhibit the generation of tar. Polyoxyalkylene ethers and the aforementioned esters of bisphenol and aliphatic acid are not satisfactory in view of the lubricity requirement. Esters of polyoxyalkylene ether and aliphatic acid and aforementioned formals tend to cause swelling in rubber-like substances. As for formals, furthermore, their yields by synthesis are inferior and there is also the problem of removing the formal-generating reagent. Orthosilicate esters have the disadvantage that hydrolysis can take place easily inside an aqueous solution. As for silicone alkylene oxide copolymer, generation of tar is not inhibited sufficiently at the time of heating so that a large amount of varnish-like tar is produced from polydimethyl siloxane.

It has thus been desirable to provide an improved lubricating agent for processing fibers which can reduce these shortcomings of the conventional lubricating agents. In order to improve production efficiency, on the other hand, attempts have also been made to increase the processing speed. Nowadays, high quality products are being introduced and fiber filaments are made smaller (lower denier) while there remain tendencies that running filaments break, burrs appear on the filaments and heaters become covered with tar. For this reason, it is not a matter of mere desire to make improvements on the conventional lubricating agents. There is a strong demand for new lubricating agents for processing fibers which can not only satisfy the requirements regarding yarn lubricity and generation of tar but also overcome the difficulties mentioned above.

SUMMARY OF THE INVENTION

As a result of research for the development of a new lubricating agent for processing fibers which can satisfy these requirements, the present inventors have discovered that a lubricating agent for processing fibers having as its main constituent polyether containing within its molecule a silicon atom which combines with certain specified groups is an appropriate choice and that a superior result can be obtained if this lubricating agent is appropriately applied to the fiber filaments.

DETAILED DESCRIPTION OF THE INVENTION

In one aspect, the present invention relates to a lubricating agent for processing fibers, this composition comprising at least one kind of silyl polyether obtrained by a reaction between polyether which is derived by ring-opening addition polymerization of cyclic ether monomers with 2 to 4 carbon atoms and contains at least one hydroxyl group within its molecule and halogenated substituted silane shown by one of the following two formulas (I) and (II):

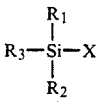

(I)

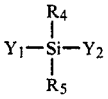

(II)

where $R_1$–$R_5$ may be the same or different, each representing hydrogen, alkyl group, cycloalkyl group, allyl group, phenyl group, alkylphenyl group or benzyl group, while $R_1$–$R_3$ cannot all be hydrogen and $R_4$ and $R_5$ cannot both be hydrogen, and X, $Y_1$ and $Y_2$ are independently chlorine, bromine or iodine.

In another aspect, the present invention relates to a method of processing thermoplastic synthetic fiber filaments according to which the filaments are lubricated by applying the aforementioned lubricating agent to the filaments at 0.1 to 3.0 weight percentage ratio during a step before the conclusion of the filament drawing and orientation.

Silyl polyethers of the present invention are completely different in chemical structure from the conventional types of silicone alkylene oxide copolymers because they are obtained by mono-, di- or tri-substituted silylation of the end hydroxyl group of conventional types of polyether. They can be used as a stable aqueous solution or emulsion because they do not undergo hydrolysis easily. If they are applied to filaments by reducing their viscosity, the coefficient of friction of the filaments can be reduced significantly. Another surprising effect which is obtained is that the amount of tar accumulated in the heater for the fabrication apparatus (such as those for drawing and false twisting) can be reduced significantly. It is not clearly understood why the generation of tar can be so significantly reduced by this kind of silylation, but it is probably because the end hydroxyl group of polyether has something to do with the starting of oxidizing thermal decomposition so that its replacement by a silyl group has the effect of suppressing the generation of radicals as well as its chain transfer reaction.

The polyethers of the present invention can be classified into the following four groups from the point of view of their structures.

(1) The type of compounds obtainable by mono-, di- or tri-substituted silylation of the end OH group of a conventionally used type of polyoxyalkylene ether compound (such as the so-called non-ionic surface active agents of the polyoxyalkylene type, polyether, polyethylene glycol, polypropylene glycol, and polytetramethylene glycol). In this case, it is not necessary to silylate all OH groups inside the molecule.

(2) The type of compounds having the structure obtainable by the condensation of two molecules of polyoxyalkylene ether compounds by a reaction between 2 mol of polyoxyalkylene ether compounds of a conventional type having one OH group within its molecule and 1 mol of dichloro (dibromo or diiodo) mono- or di-substituted silane.

(3) The type of compounds having the structure obtainable by polycondensation reaction of polyoxyalkylene ether of a conventional type having two OH groups within its molecule and dichloro (dibromo or diiodo) mono- or di-substituted silane and the type of compounds obtainable by plugging the end of a compound of the former type with a compound having one OH group or monochloro (monobromo or monoiodo) tri-substituted silane.

(4) The type of compounds having a complicated three-dimensional structure, obtainable by a reaction between polyoxyalkylene ether of a conventional type having three or more OH groups within its molecule and dichloro (dibromo or diiodo) mono- or di-substituted silane.

Of the above four groups, Groups (1)–(3) are superior from the point of view of lubricity. Silyl polyethers belonging to these groups can be described generally by the following two formulas:

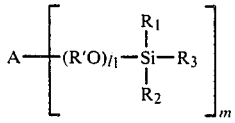

(III)

and

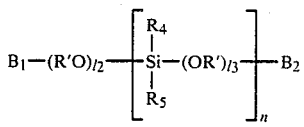

(IV)

where $R_1$–$R_5$ are the same as in (I) and (II); R′ may be the same or different among themselves, each representing an alkylene group with 2 to 4 carbon atoms; A represents a monovalent to hexavalent residual such that $AH_m$ will represent monohydric to hexahydric alcohol (preferably with 1–18 carbon atoms), phenol, substituted phenol (preferably with 9–18 carbon atoms), carboxylic acid (preferably with 2 to 18 carbon atoms), alkyl (preferably with 8 to 18 carbon atoms) or alkenyl (preferably with 8 to 18 carbon atoms) amine alkylene(-preferably with 2 to 10 carbon atoms)polyamine, alkyl- or alkenyl (preferably with 2 to 18 carbon atoms)-amide, thioether (preferably with 8 to 18 carbon atoms) or mercaptan (preferably with 8 to 18 carbon atoms); $B_1$ and $B_2$ represent individually hydroxyl group, alkoxy group, alkenoxy group, phenoxy group, substituted phenoxy group (preferably with 9 to 18 carbon atoms), acyloxy group (preferably with 2 to 18 carbon atoms), alkyl- or alkenylamino (preferably with 8 to 18 carbon atoms) group, alkyl- or alkenyl-amide (preferably with 2 to 18 carbon atoms) group or the radical shown below:

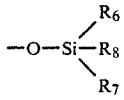

where $R_6$–$R_8$ are the same as in the case of $R_1$–$R_5$; $l_1$–$l_3$ are individually an integer in the range of 1 to 20 and may be the same or different; m is an integer in the range of 1 to 6; and n is an integer in the range of 1 to 10.

Silyl polyethers of the present invention, as shown above, have various structures and molecular weights in a wide range. Proper selection must be made of these, depending on the type of fibers to which it is to be applied and the conditions under which these fibers are processed (such as the conditions of the heating processes). Fibers of the cellulose type, for example, have low fiber strength and since lubricity becomes an important factor for them, compounds with a relatively short polyoxyalkylene chain, or those with a low molecular weight (say, less than about 700), are preferable. Among thermoplastic synthetic fibers, filaments which are woven and knitted into flat yarns also are required excellent lubricity, so that those with a relatively low molecular weight (say, less than about 700) are preferred. If the drawing temperature exceeds 200° C., however, those with a higher molecular weight are better suited for preventing fuming. For filaments which undergo a process of false twisting, those with molecular weight greater than about 700 are also preferable for preventing fuming. In the case of high-speed false twisting with yarn velocity speed in the range of 500 to 1000 m/min, in particular, the lubricating agent is scattered around due to the centrifugal force of the rotary motion of the filament so that those with molecular weight greater than about 1500 are preferable.

There will next be explained some examples of the synthesis of silyl polyethers of the present invention. The halogenated substituted silane according to the aforementioned formulas (I) and (II), which are used for the synthesis of such silyl polyethers, have 1 to 3 substituents and these substituents are alkyl group (preferably with 1 to 18 carbon atoms), cycloalkyl group (preferably an alkyl chain with 1 to 18 carbon atoms), allyl group, phenyl group, alkylphenyl group (preferably an alkyl chain with 1 to 18 carbon atoms) or benzyl group. They may be, for example, dimethylhydrogen chlorosilane, trimethyl chlorosilane, dimethyl dichlorosilane or diphenyl dichlorosilane. To commence, polyether and pyridine are placed inside a glass flask with a stirrer and a thermometer and the aforementioned halogenated substituted silane is dropped while the stirring is continued at a temperature below 40° C. Reaction is continued for 2 to 3 hours after the dropping and silyl ether is obtained by removing the byproduct pyridine hydrohalides (hydrochlorides, hydrobromides or hydroiodides) after the end of the reaction. Examples of polyethers to be used here include compounds obtained in the presence of a catalyst by block or random ring-opening addition polymerization of cyclic ether monomers such as ethylene oxide, propylene oxide, butylene oxide and tetrahydrofuran to alcohol such as methanol, ethanol, butanol, 2-ethylhexanol, dodecanol, stearyl alcohol, ethyleneglycol, glycerol, trimethylolpropane, pentaerythritol, dipentaerythritol, etc., a carboxylic acid such as capric acid, lauric acid, adipic acid, sebacic acid, phthalic acid, trimellitic acid, pyromellitic acid, etc., an amide of carboxylic acid such as lauric amide, oleic amide, stearic amide, etc., an amine-type compound such as lauryl amine, oleyl amine, ethylene diamine, diethylene triamine, triethanol amine, etc., a thioether-type or mercaptan-type compound such as thioglycol, 1-thioglycerol, ethylene bis(2-hydroxyethyl) sulfide, triethyleneglycol dimercaptan, betaphenyl thioethanol, etc.

There are shown below individual examples of silyl polyether thus synthesized and used according to the present invention but these examples are not intended to limit the scope of the present invention:

(A)

$$R—O—(PO/EO)—Si(Me)_3$$

where $R=C_4H_9$; PO hereinafter indicates propyleneoxy group; EO hereinafter indicates ethyleneoxy group; PO/EO=50/50 (random coupling); $—Si(Me)_3$ hereinafter indicates

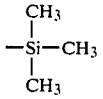

and MW (average molecular weight)=2000.

(B)

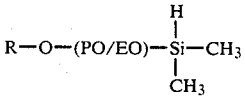

where R is a 1:1 mixture of $C_{12}H_{25}$ and $C_{13}H_{27}$; PO/EO=60/40; and MW=2000.

(C)

$$(Me)_3Si—(EO)—(PO)—OCH_2—CH_2O—(PO)—(EO)—Si(Me)_3$$

where PO/EO=25/75 and MW=2000.

(D)

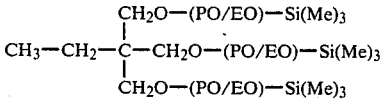

where PO/EO=70/30 and MW=2000.

(E)

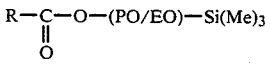

where $R=C_{11}H_{23}$; PO/EO=60/40; and MW=2500.

(F)

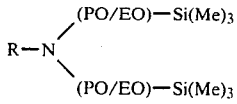

where $R=C_{12}H_{25}$; PO/EO=75/25; and MW=2500.

(G)

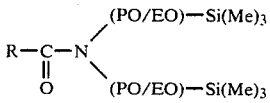

where $R=C_{11}H_{23}$; PO/EO=75/25; and MW=2500.

(H)

$$(Me)_3Si—(EO/PO)—OC_2H_4—S—C_2H_4O—(PO/EO)—Si(Me)_3$$

where PO/EO=65/35 and MW=2500.

(I)

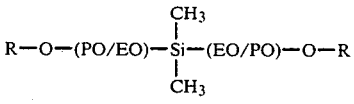

where $R=CH_3$; PO/EO=50/50; and MW=2000.

(J)

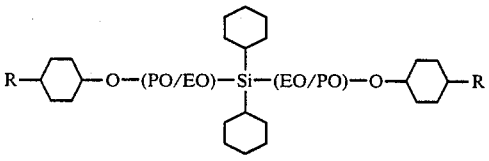

where $R=C_4H_9$; PO/EO=60/40; and MW=2500.

(K)

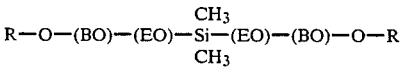

where $R=C_4H_9$; BO means 1,2-oxybutylene group; BO/EO=30/70(weight ratio); and MW=2000.

(L)

$$(Me)_3Si—(EO)—(PO)—(B'O)—(PO)—(EO)—Si(Me)_3$$

where B'O means 1,4-oxybutylene group; B'O/PO/EO=40/30/30 (weight ratio); and MW=2000.

(M)

$$R—O—CH_2CH_2O—Si(Me)_3$$

where $R=C_{18}H_{35}$.

(N)

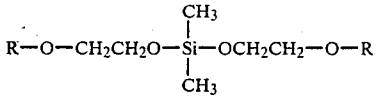

where $R=C_{12}H_{25}$.

(P)

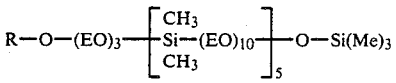

where $R=C_{12}H_{25}$.

There is no particular limitation regarding the concentration of these silyl polyethers in a lubricating agent of the present invention as long as the desired purposes of the present invention are achieved. The lubricating agents of the present invention, furthermore, may contain not only silyl polyether but appropriately also a lubricating agent, an antistatic agent, an emulsifier, a wetting agent, an anti-moulding agent and/or an anti-rusting agent.

Examples of lubricating agent that may be contained include refined mineral oils, aliphatic ether esters and polyethers derived from ethylene oxide or propylene oxide. A refined mineral oil with Redwood kinetic viscosity of 40–500 seconds at 30° C., for example, may be used. Among the esters of synthetic aliphatic acids, use may be made of esters of aliphatic monobasic acid and aliphatic monohydric alcohol, esters of polyhydric alcohol such as ethylene glycol, diethylene glycol, neopentyl glycol, trimethylol propane, glycerol, pentaerythritol, etc. and aliphatic monobasic acid or esters of aliphatic dibasic acid and aliphatic monohydric alcohol. Actual examples of esters of synthetic aliphatic acids include butylstearate, n-octylpalmitate, 2-ethylhexyl palmitate, oleyl laurate, isohexadecyl laurate, isostearyl laurate, dioctyl cebacate, diisotridecyl adibate, ethylene glycol dioleate, trimethylol propane trioctanoate, pentaerythritol tetraoctanoate, etc. As for aliphatic ether esters, use may be made of ester of polyoxyethylene (5 mol) lauryl ether and lauric acid, diester of polyoxyethylene (5 mol) decylether and adipic acid, ester of polyoxyethylene (2 mol) polyoxypropylene (1 mol) octyl ether and palmitic acid, etc. As for polyethers, use may be made of those obtainable by random or block addition polymerization of propylene oxide and ethylene oxide to methanol, ethanol, butanol, octanol, lauryl alcohol, stearyl alcohol, etc., those obtainable by random or block addition polymerization of propylene oxide and ethylene oxide to polyhydric alcohol such as propylene glycol, trimethylol propane, glycerol, pentaerythritol, sorbitol, etc. with molecular weights in a wide range.

Examples of aforementioned antistatic agents include anionic surface active agents such as sulfonates, phosphates and carboxylates, cationic surface active agents of the quaternary ammonium salt type and amphoteric surface active agents of the imidozoline type, betaine type and sulfobetaine type, while examples of aforementioned nonionic surface active agents include polyoxyethylene alkyl ether, polyoxyethylene alkylphenyl ether, polyoxyethlene alkyl ester and partial alkyl esters of polyhydric alcohols.

The lubricating agents of the present invention show their effectiveness when applied to fibers as spin finish or as coning oil. They may be applied to fibers either as an aqueous emulsion, a solution with an organic solvent or by themselves (straight oiling). The amount of lubricating agent deposited on the fiber is usually 0.20–2.0 weight % when applied as spin finish lubricant and 0.5–3.0 weight % when applied as coning oil.

The lubricating agents of the present invention explained above exhibit high levels of effectiveness when they are applied to thermoplastic synthetic fibers such as polyesters, polyamides, polypropylene, polyacrylonitrile, etc., cellulose-type fibers such as rayon, cupra, acetates, etc. and also many types of natural fibers. A comparison with the conventional lubricating agents and their constituents show that aforementioned silyl polyethers which play central roles in the lubricating agents of the present invention bring about superior libricating capability and ability to reduce generation of tar. Moreover, these silyl polyethers have many advantages regarding their production such that they can be synthesized easily and that compounds which did not participate in the reaction can be removed easily.

When they are used in the production process of thermoplastic synthetic fibers such as polyesters, polyamides, polypropylene and polyacrylonitrile, they are particularly effective if they are applied at the rate of 0.1–3.0 weight % or preferably 0.2–2.0 weight % with respect to such thermoplastic synthetic fibers and if it is done during a step prior to the completion of the drawing and orientation of these fibers because the aforementioned effects can continue throughout the subsequent production processes (inclusive of heating processes).

In order to explain the present invention more concretely, there will subsequently be shown examples of synthesis of silyl polyethers (hereinafter abbreviated as Si-PE) according to the present invention together with evaluation of their characteristics. In what follows, symbols Si-PE(A)–(P) will refer to the individual examples (A)–(P) of silyl polyethers illustrated before.

Example of synthesis No. 1 (synthesis of Si-PE(A))

Polyether of MW=2000 (500 g, or 0.25 mol) obtained by random addition polymerization with PO and EO in weight ratio of 50:50 and n-butanol was placed inside a glass reaction vessel of volume 1 liter (with an agitator and a reflux condenser) and after 22.75 g (0.25 mol) of pyridine was added and stirred to make a uniform mixture, 27.125 g (0.25 mol) of trimethyl chlorosilane was gradually added from a dropping funnel at a reaction temperature below 40° C. The temperature was maintained below 40° C. even after the dropping was completed and the reaction was continued for 2 to 3 hours. While pyridine hydrochloride is separated as the reaction goes on, the system pressure was reduced after the completion of the reaction, and after the temperature was raised to about 100° C. and small amounts of unreacted pyridine and trimethyl chlorosilane were removed from the system, pyridine hydrochloride was taken out of the system and the reaction product (silyl polyether) was obtained.

According to an analysis by the proton nuclear magnetic resonance method (hereinafter abbreviated as NMR), the reaction ratio (fraction of the OH group of polyether converted into trimethylsilyl group) was about 80%.

Example of synthesis No. 2 (synthesis of Si-PE(I))

Polyether of MW=1000 (500 g, or 0.5 mol) obtained by random addition polymerization with PO and EO in weight ratio of 50:50 and methanol was mixed with 45.5 g (0.5 mol) of pyridine and 32.25 g (0.25 mol) of dimethyl dichlorosilane and reaction product was obtained by using the same apparatus and method of operation as in the previous example. The reaction ratio was about 90% by an NMR analysis.

Examples of test and comparison experiments Nos. 1–5

Lubricating agents for test and comparison experiments Nos. 1–5 shown in Table 1 were individually prepared. A 10-weight % emulsion each of these lubricating compositions was applied individually by kiss-roll method onto commercially available nylon filaments (semi-dull 70-denier 24-filament) degreased by cyclohexane and dried. The amount of lubricant deposited was 0.8–1.0 weight % on fiber. Coefficient of friction was measured for each filament and the rate of tar generation was measured for each lubricating composition. The results are shown in Table 1 wherein examples of test and comparison experiments assigned the same number correspond to each other, showing the silylation effects on polyether. One can see from the results of Table 1 that the lubricating agents of the present invention have lower coefficients of friction and lower rates of tar generation than those of conventional types.

Evaluation of the characteristics described in Table 1 was made in the following ways:

(i) Measurement of coefficient of friction

A lubricated nylon filament was used for measurement by a μ-meter (made by Eiko Sokuki Kabushiki Kaisha) under the following conditions: Friction pin=-Cylindrical plated pin of 25 mm in diameter; Contact angle between filament and friction pin=90°; Initial tension ($T_1$)=20 g; Sliding speed of filaments=300 m/min; Environment=25° C.×65% RH. The filament tension immediately after the friction pin was measured ($T_2$) and the coefficient of friction was calculated by the following formula:

$$\text{Coefficient of friction} = A \ln T_2/T_1$$

where A is a factor determined by the angle of contact and ln is the natural logarithm. Lubricity is the better, the smaller the coefficient of friction.

(ii) Measurement of the rate of tar generation

Three grams of lubricating agents was weighed accurately in a stainless steel dish having diameter of 8 cm and depth of 8 mm. After it was put in a heater box at the temperature of 230° C. for 48 hours and cooled in a dessicator, it was weighed accurately again. The ratio of the tarry residue to the effective content of original lubricant was calculated from the data obtained before.

(iii) Standards of evaluation

| Coefficient of friction | | Rate of tar generation | |
|---|---|---|---|
| O | Less than 0.30 | O | Less than 10% |
| Δ | 0.30–0.35 | Δ | 10–20% |
| X | 0.35 or over | X | 20% or over |

TABLE 1

| | Test | | | | | Comparison | | | | |
|---|---|---|---|---|---|---|---|---|---|---|
| | 1 | 2 | 3 | 4 | 5 | 1 | 2 | 3 | 4 | 5 |
| Si—PE (E) | 50 | | | | | | | | | |
| Si—PE (F) | | 50 | | | | | | | | |
| Si—PE (G) | | | 50 | | | | | | | |
| Si—PE (H) | | | | 50 | | | | | | |
| Si—PE (J) | | | | | 50 | | | | | |
| (E1) | | | | | | 50 | | | | |
| (F1) | | | | | | | 50 | | | |
| (G1) | | | | | | | | 50 | | |
| (H1) | | | | | | | | | 50 | |
| (J1) | | | | | | | | | | 50 |
| *1 | 20 | 20 | 20 | 20 | 20 | 20 | 20 | 20 | 20 | 20 |
| *2 | 25 | 25 | 25 | 25 | 25 | 25 | 25 | 25 | 25 | 25 |
| *3 | 5 | 5 | 5 | 5 | 5 | 5 | 5 | 5 | 5 | 5 |
| Coef. of Friction | O | O | O | O | O | Δ | Δ | Δ | X | X |
| Tar generation | O | O | O | Δ | Δ | Δ | Δ | Δ | X | X |

In Table 1, the numbers are in units of weight %, *1=octyl stearate, *2=POE(8)lauryl ether, *3=potassium dodecanyl succinate, and (E1): R—COO—(PO/EO)—H
where R = $C_{11}H_{22}$, PO/EO = 60/40 and MW = 2500;

(F1): R—N(—(PO/EO)—H)(—(PO/EO)—H)
where R = $C_{12}H_{25}$, PO/EO = 75/25 and MW = 2500;

(G1): R—CON(—(PO/EO)—H)(—(PO/EO)—H)
where R = $C_{11}H_{23}$, PO/EO = 75/25 and MW = 2500;

(H1): S(—$C_2H_4$—O—(PO/EO)—H)(—$C_2H_4$—O—(PO/EO)—H)
where PO/EO = 65/35 and MW = 2500;

(J1): R—⬡—O—(PO/EO)—$CH_2$—(EO/PO)—O—⬡—R

Examples of test and comparison experiments Nos. 6–11

The lubricating agents for test and comparison experiments Nos. 6–11 shown in Table 2 were individually prepared. A 10% weight of emulsion each of these lubricating agents was applied individually by kiss-roll method onto commercially available polyester filaments (semi-dull 75-denier 36-filament) degreased by cyclohexane and dried. The amount of lubricant deposited on fiber was 0.4–0.6 weight %. Coefficient of friction and the rate of tar generation were measured as before. The results are shown in Table 2 wherein examples of test and comparison experiments assigned the same number correspond to each other, showing the silylation effects on polyether. One can see also from the results of Table 2 that the lubricating agents of the present invention have lower coefficients of friction and lower rates of tar generation than those of conventional types.

(i) Standards of evaluation.

| Coefficient of friction | | Tar generation | |
|---|---|---|---|
| O | 0.30–0.35 | O | Less than 1% |

-continued

| Coefficient of friction | | Tar generation | |
|---|---|---|---|
| Δ | Over 0.35 | Δ | 1–5% |

TABLE 2

| | Test | | | | | | Comparison | | | | | |
|---|---|---|---|---|---|---|---|---|---|---|---|---|
| | 6 | 7 | 8 | 9 | 10 | 11 | 6 | 7 | 8 | 9 | 10 | 11 |
| Si—PE (A) | 98 | | | | | | | | | | | |
| Si—PE (B) | | 98 | | | | | | | | | | |
| Si—PE (C) | | | 98 | | | | | | | | | |
| Si—PE (D) | | | | 98 | | | | | | | | |
| Si—PE (I) | | | | | 98 | | | | | | | |
| Si—PE (K) | | | | | | 98 | | | | | | |
| (A-2) | | | | | | | 98 | | | | | |
| (B-2) | | | | | | | | 98 | | | | |
| (C-2) | | | | | | | | | 98 | | | |
| (D-2) | | | | | | | | | | 98 | | |
| (I-2) | | | | | | | | | | | 98 | |
| (K-2) | | | | | | | | | | | | 98 |
| *4 | 2 | 2 | 2 | 2 | 2 | 2 | 2 | 2 | 2 | 2 | 2 | 2 |
| Coef. of friction | O | O | O | O | O | O | Δ | Δ | Δ | Δ | Δ | Δ |
| Tar generation | O | O | O | O | O | O | Δ | Δ | Δ | Δ | Δ | Δ |

In Table 2, *4 is sodium alkylsulfonate and (A-2): R—O—(PO/EO)—H where R=$C_4H_9$, PO/EO=50/50 and MW=2000;

(B-2): R—O—(PO/EO)—H where R=1:1 mixture of $C_{12}H_{25}$ and $C_{13}H_{27}$, PO/EO=60/40 and MW=2000;

(C-2):
H—(EO)—(PO)—$OCH_2CH_2O$—(PO)—(EO)—H where PO/EO=25/75 and MW=2000;

(D-2):
$$CH_3-CH_2-C(CH_2O-(PO/EO)-H)_3$$

where PO/EO=70/30 and MW=2000;

(I-2): R—O—(PO/EO)—$CH_2$—(EO/PO)—O—R where R=$CH_3$, PO/EO=50/50 and MW=2000; and (K-2):
R—O—(BO)—(EO)—$CH_2$—(EO)—(BO)—O—R where R=$C_4H_9$, BO/EO=30/70 and MW=2000.

Examples of test and comparison experiments Nos. 12 and 13

The lubricating agents for test and comparison experiments Nos. 12 and 13 shown in Table 3 were individually prepared. Each of these lubricating agents was applied by the neat oiling method to commercially available acetate filaments (bright 75-denier 20-filaments) degreased by diethylether. The amount of lubricant deposited on fiber was 1.5–2.0 weight %. Coefficient of friction was measured as before in the case of Table 1 and evaluated according to the following standards. The results are shown in Table 3. One can see also from the results of Table 3 that the lubricating agents of the present invention have lower coefficients of friction than the mineral oils which have been used conventionally as smoothening agent for lubricants for acetates.

Standards of evaluation:

| Coefficient of friction | |
|---|---|
| | Less than 0.22 |
| O | 0.22–0.25 |
| Δ | 0.25–0.28 |
| X | 0.28 or greater |

TABLE 3

| | Test | | Comparison | |
|---|---|---|---|---|
| | 12 | 13 | 12 | 13 |
| Si—PE (M) | 90 | | | |
| Si—PE (N) | | 90 | | |
| Mineral oil (60 RW second) | | | 90 | |
| Mineral oil (90 RW second) | | | | 90 |
| Sorbitan monooleyate | 10 | 10 | 10 | 10 |
| Coefficient of friction | | | | |

Examples of test experiments Nos. 14–17 and comparison experiments Nos. 14–16

The lubricating agents for test experiments Nos. 14–17 and comparison experiments Nos. 14–16 shown in Table 4 were individually prepared. A partially oriented yarn (POY) was prepared for each case by the method described below and such POY was used for draw-false twist-texturing and studies were made about the following items: (1) cross yarn of POY, (2) friction coefficient of POY, (3) appearance of fuzz on draw texturing yarn, and (4) the amount of tar on the heaters. The results are shown in Table 4. One can see from the results of Table 4 that the POY cross yarn, the tar generation, fuzz of draw textured yarn and the coefficienit of friction are small if a lubricating agent of the present invention is used.

(i) Production of POY

Immediately after melt spinning of polyethylene terephthalate, a 10%-emulsion of lubricating agent was applied to the kill-roll method and a 12-kg cake of POY with 115 denier 36 filaments was obtained by winding at the rate of 3500 m/min. The amount of lubricant deposited on POY was 0.4–0.5 weight %.

(ii) Draw-false twist texturing

Twisting system=three-axis friction method (hard urethane rubber disk); Speed of yarn=600 m/min; Draw ratio=1.518; Heater on twist side=2 m in length with surface temperature of 220° C.; Heater on untwisting side=none; Intended number of turns=3200 T/m.

(iii) Evaluation of cross yarn on POY cake

It was examined by observation whether any filament was slipping off in a straight line on the side surface of the POY cake. Its occurrence can cause the filament to break when a POY is unwound in a draw texturing process.

(iv) Evaluation of friction coefficient of POY

Coefficient of friction was measured in the same way as for Table 1 except that polyester POY was used for testing. Evaluation was made by the following standards:

O=Coefficient of friction smaller than 0.35

Δ=Coefficient of friction 0.35 or greater (v) Evaluation of appearance of fuzz

It was examined by observation whether there was fuzz generated on the side surface of the cheese (2-kg roll) of false twisted yarn.

(vi) Evaluation of tar on heaters

After a continuous operation for 10 days under the aforementioned conditions of draw-false twisting, a magnifier was used to examine by observation whether or not tar had been generated in the filament passage on the surface of heater. Evaluation was made by the following standards:

O = Tar adhesion hardly observed

Δ = Some tar adhesion observed

TABLE 4

| | Test | | | | Comparison | | |
|---|---|---|---|---|---|---|---|
| | 14 | 15 | 16 | 17 | 14 | 15 | 16 |
| Si—PE (A) | | 60 | 30 | | | | |
| Si—PE (I) | 99 | | | | | | |
| Si—PE (P) | | | | 30 | | | |
| (A-2) | | | | | | 60 | 30 |
| (I-2) | | 39 | 69 | 69 | 99 | 39 | 39 |
| Sodium alkylsulfonate | 1 | 1 | 1 | 1 | 1 | 1 | 1 |
| Cross Yarn on POY Cake | No | No | No | No | No | No | No |
| Coef. of POY friction | O | O | O | O | Δ | Δ | Δ |
| Fuzz on POY Cake | No | No | No | No | No | No | No |
| Tar on heaters | O | O | O | O | Δ | Δ | Δ |

In Table 4, (A-2) and (I-2) are as defined for Table 2.

Examples of test experiments Nos. 18 and 19

Polyester POY was prepared by using a lubricating agent having the following composition and by the same method used for Table 4 (Experiment No. 18):

Si-PE(K): 45 weight %

Isooctylpalmitate: 10 weight %

$C_{12}H_{25}O[(C_3H_6O)_{20}(C_2H_4O)_{18}]_BH$: 40 weight %

Sodium alkylsulfonate: 5 weight % where B represents block polymerization structure.

This POY was draw-false twisted by the same method as before for Table 4 and 1.5–2.0% weight of a lubricating agent of the following composition was applied (Experiment No. 19) as coning oil immediately before it was wound up:

Si-PE(M): 60 weight %

Mineral oil (60-second Redwood): 30 weight %

Sorbitan monooleate: 5 weight %

POE (5 mol) nonylphenylether: 4 weight %

10 cst/30° C. dimethylsilicon: 1 weight %

This false twisted yarn was used for weaving with a water jet loom but no problem was observed at all and good results were obtained.

We claim:

1. A lubricating agent for processing fibers comprising at least one kind of silyl polyether obtainable as a reaction product between polyether which is derived by ring-opening addition polymerization of cyclic ether monomers with 2 to 4 carbon atoms and the molecule of which contains at least one hydroxyl group and halogenated substituted silane shown by formula

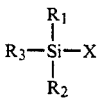

(I)

-continued

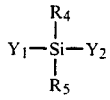

(II)

where $R_1$–$R_5$ may be alike or different, each representing hydrogen, alkyl group, cycloalkyl group, allyl group, phenyl group, alkylphenyl group or benzyl group, $R_1$–$R_3$ are not all hydrogen, $R_4$ and $R_5$ are not both hydrogen and X, $Y_1$ and $Y_2$ represent individually chlorine, bromine or iodine.

2. The lubricating agent of claim 1 wherein said silyl polyether is a compound shown by formula

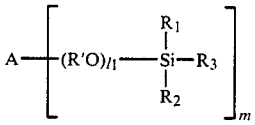

(III)

or

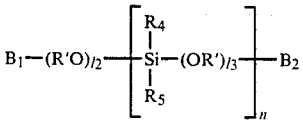

where R′ are similar or different, each representing alkylene group with 2 to 4 carbon atoms; A is an organic substituent such that $AH_m$ is monohydric-hexahydric alcohol, phenol, substituted phenol, carboxylic acid, alkylamine, alkenylamine, alkylene polyamine, alkylamide, alkenylamide, thioether or mercaptan; $B_1$ and $B_2$ represent individually hydroxyl group, alkoxy group, alkenoxy group, phenoxy group, substituted phenoxy group, acyloxy group, alkyl or alkenyl amino group, alkyl or alkenyl amide group or

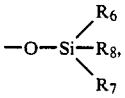

$R_6$–$R_8$ being defined similarly as $R_1$–$R_5$ for (I) and (II); $l_1$–$l_3$ are individually an integer in the range of 1–200 and may be alike or different; m is an integer in the range of 1–6; and n is an integer in the range of 1–10.

3. A method of processing a thermoplastic synthetic fiber filaments comprising the step of lubricating said fiber filaments by applying thereonto a lubricating agent at a rate of 0.1–3.0 weight % with respect to said fiber filaments, said lubricating agent comprising at least one kind of silyl polyether obtainable by a reaction between polyether having one or more hydroxyl group in its molecule and derivable by ring-opening addition polymerization of cyclic ether monomers with 2 to 4 carbon atoms and halogenated substituted silane shown by formula

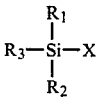

(V)

or

-continued

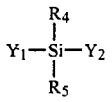

(VI)

where $R_1$–$R_5$ may be alike or different, each representing hydrogen, alkyl group, cycloalkyl group, allyl group, phenyl group, alkylphenyl group or benzyl group, $R_1$–$R_3$ are not all hydrogen, $R_4$ and $R_5$ are not both hydrogen, and X, $Y_1$ and $Y_2$ represent individually chlorine, bromine or iodine.

4. The method of claim 3 further comprising the step of drawing and orienting said filaments, said lubricating step taking place prior to said step of drawing and orienting.

* * * * *